US009550087B2

(12) United States Patent
Tansil

(10) Patent No.: US 9,550,087 B2
(45) Date of Patent: Jan. 24, 2017

(54) EXERCISE ASSEMBLY

(71) Applicant: Martin Tansil, Detroit, MI (US)

(72) Inventor: Martin Tansil, Detroit, MI (US)

( * ) Notice: Subject to any disclaimer, the term of this patent is extended or adjusted under 35 U.S.C. 154(b) by 27 days.

(21) Appl. No.: 14/614,935

(22) Filed: Feb. 5, 2015

(65) Prior Publication Data

US 2016/0228738 A1 Aug. 11, 2016

(51) Int. Cl.

| | |
|---|---|
| ***A63B 21/00*** | (2006.01) |
| ***A63B 21/075*** | (2006.01) |
| ***A63B 23/02*** | (2006.01) |
| ***A63B 23/12*** | (2006.01) |

(52) U.S. Cl.

CPC ..... *A63B 21/075* (2013.01); *A63B 21/0004* (2013.01); *A63B 21/00065* (2013.01); *A63B 21/4035* (2015.10); *A63B 21/4043* (2015.10); *A63B 23/0205* (2013.01); *A63B 23/0233* (2013.01); *A63B 23/12* (2013.01)

(58) Field of Classification Search

CPC ..... A63B 21/0004; A63B 21/00043; A63B 21/00061; A63B 21/00065; A63B 21/06; A63B 21/0609; A63B 21/065; A63B 21/072; A63B 21/0724; A63B 21/0726; A63B 21/075; A63B 21/4035; A63B 21/4043; A63B 69/0028; A63B 2225/68; A63B 2225/682; A63B 2225/685; A63B 2225/687

See application file for complete search history.

(56) References Cited

U.S. PATENT DOCUMENTS

| | | | | |
|---|---|---|---|---|
| 4,603,858 | A | 8/1986 | Reehill | |
| 5,242,349 | A * | 9/1993 | Reiff | A63B 21/072 222/175 |
| 5,318,492 | A * | 6/1994 | Quinn | A63B 21/072 222/175 |
| 5,325,997 | A * | 7/1994 | Washington | F41H 9/10 222/175 |
| 5,332,119 | A * | 7/1994 | Davis | F41H 9/10 222/175 |
| 5,709,635 | A * | 1/1998 | Denison | F41H 9/10 222/175 |
| 6,248,047 | B1 | 6/2001 | Abdo | |
| 6,957,750 | B1 | 10/2005 | Trudell | |
| 7,654,275 | B2 | 2/2010 | Ewell et al. | |
| 7,766,804 | B2 | 8/2010 | Placencia | |
| 8,105,216 | B2 | 1/2012 | Hazan et al. | |
| 2014/0024503 | A1* | 1/2014 | Chiang | A63B 69/004 482/83 |
| 2014/0323251 | A1* | 10/2014 | Estrada | A63B 59/007 473/564 |

* cited by examiner

*Primary Examiner* — Loan H Thanh
*Assistant Examiner* — Jennifer M Deichl

(57) ABSTRACT

An exercise assembly includes a grippable member that may be held by a person while the person is walking to facilitate the engagement of upper body muscles. A plurality of weights is provided and a selected number of the weights is removably positioned within the grippable member. The weights provide a selectable amount of resistance to the person while the person holds the grippable member. A weapon is removably positioned within one of the grippable member to be utilized by the person for defense purposes.

7 Claims, 3 Drawing Sheets

EXERCISE ASSEMBLY

BACKGROUND OF THE DISCLOSURE

Field of the Disclosure

The disclosure relates to exercise devices and more particularly pertains to a new exercise device for exercising upper body muscles of a person while the person is walking.

SUMMARY OF THE DISCLOSURE

An embodiment of the disclosure meets the needs presented above by generally comprising a grippable member that may be held by a person while the person is walking to facilitate the engagement of upper body muscles. A plurality of weights is provided and a selected number of the weights is removably positioned within the grippable member. The weights provide a selectable amount of resistance to the person while the person holds the grippable member. A weapon is removably positioned within one of the grippable member to be utilized by the person for defense purposes.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
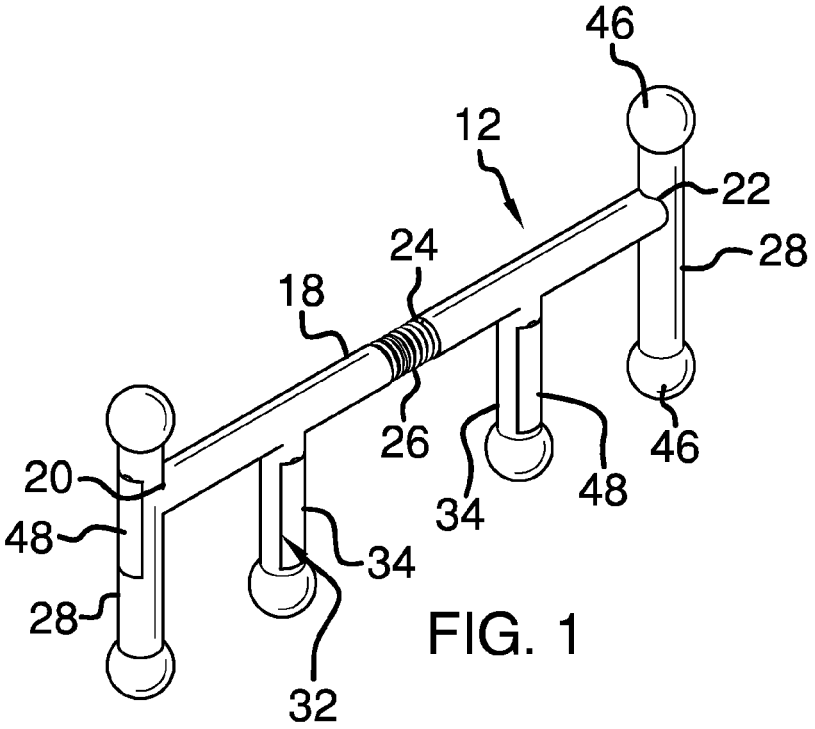
FIG. 1 is a top perspective view of a exercise assembly according to an embodiment of the disclosure.
Figure 2:
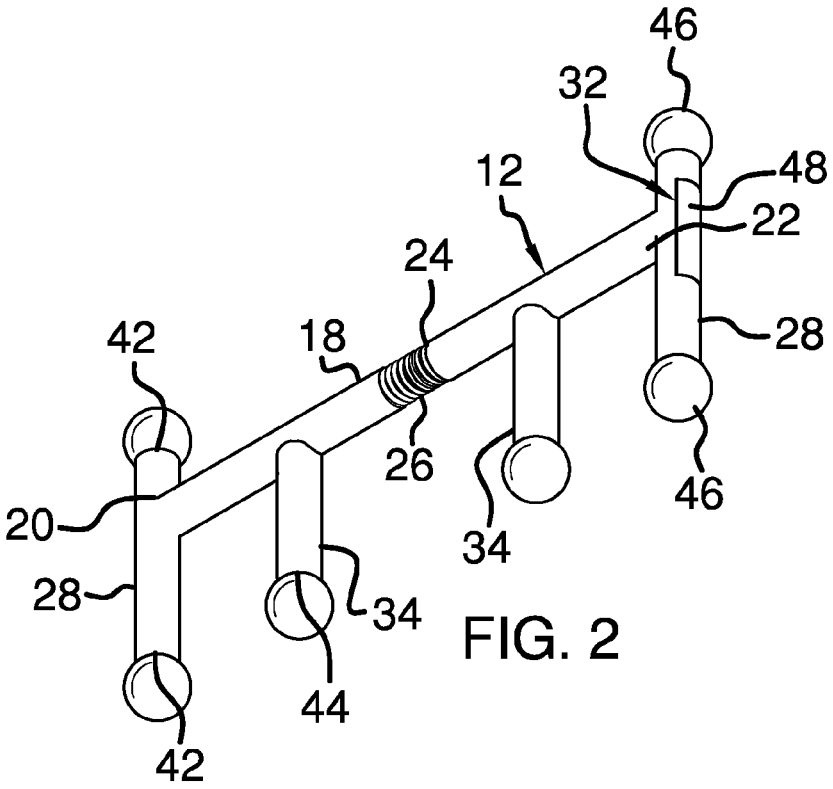
FIG. 2 is a bottom perspective view of an embodiment of the disclosure.
Figure 3:
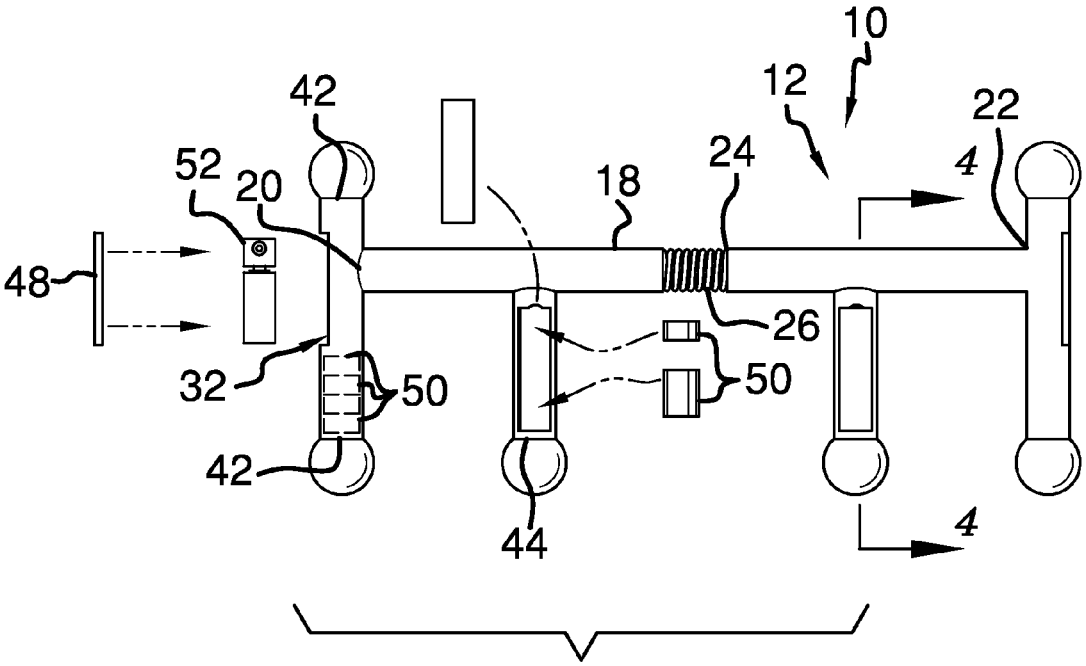
FIG. 3 is a front view of an embodiment of the disclosure.
Figure 4:
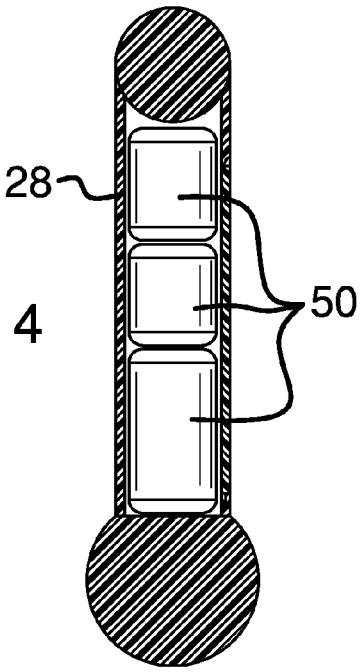
FIG. 4 is a cross sectional view taken along line 4-4 of FIG. 3 of an embodiment of the disclosure.
Figure 5:
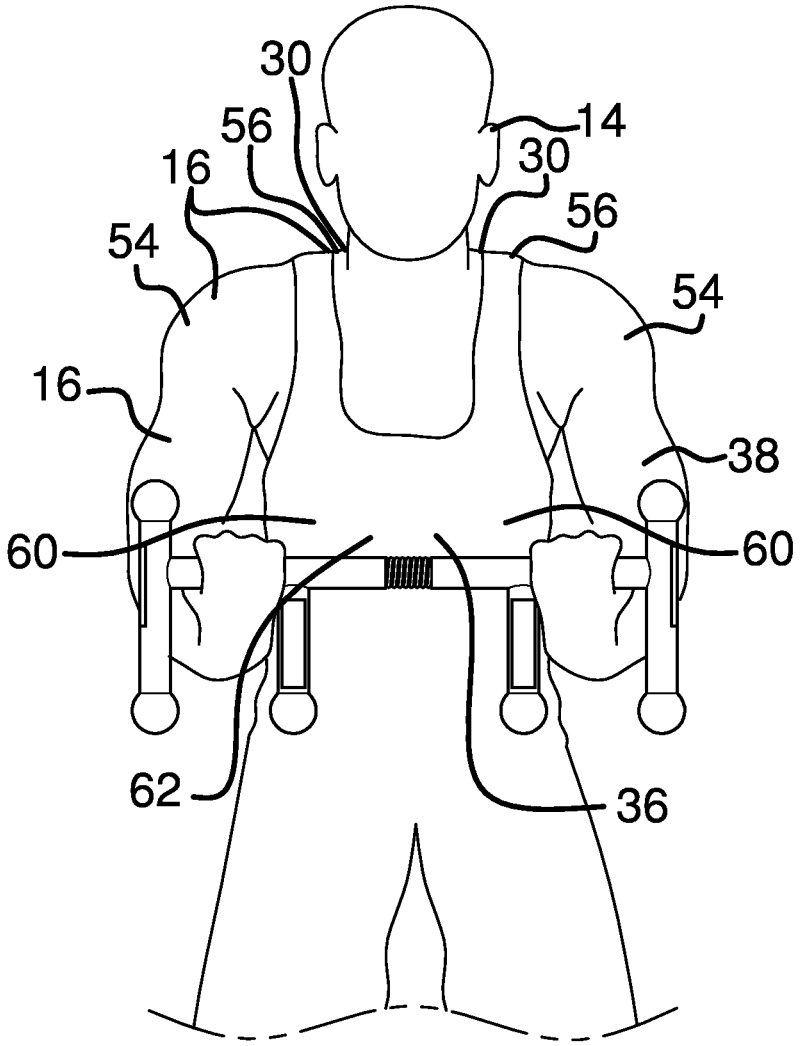
FIG. 5 is an in-use view of an embodiment of the disclosure.

With reference now to the drawings, and in particular to FIGS. 1 through 5 thereof, a new exercise device embodying the principles and concepts of an embodiment of the disclosure and generally designated by the reference numeral 10 will be described.

As best illustrated in FIGS. 1 through 5, the exercise assembly 10 generally comprises a grippable member 12 the may be held by a person 14 while the person 14 is walking to facilitate the engagement of upper body muscles 16. The grippable member 12 comprises a central shaft 18 that has a first end 20 and a second end 22. The central shaft 18 has a break 24 therein and the break 24 is centrally positioned on the central shaft 18. The central shaft 18 may have a spring

26 extending across the break 24 such that the central shaft 18 is flexible. The central shaft 18 may have a length between 32 inches and 40 inches.

A pair of end shafts 28 is provided and one of the end shafts 28 is coupled to the first end 20 and one of the end shafts 28 the second end 22. Each of the end shafts 28 is oriented transverse to a longitudinal axis extending through the first end 20 and the second end 22 and each of the end shafts 28 may be gripped by the person 14 to engage back muscles 30 of the person 14. Each of the end shafts 28 may have a length between 6 inches and 10 inches. Additionally, each of the end shafts 28 may extend upwardly from the central shaft 18 a distance generally between 2 inches and 3 inches and downwardly from the central shaft 18 a distance generally between 4 inches and 7 inches.

A pair of medial shafts 34 is coupled to the central shaft 18 and each of the medial shafts 34 is spaced inwardly from one of the end shafts 28. Each of the medial shafts 34 is oriented perpendicular to the central shaft 18 such that the medial shafts 34 are aligned with the end shafts 28. The medial shafts 34 may be gripped by the person 14 to engage abdominal muscles 36 of the person 14. The central shaft 18 may be gripped between the end shafts 28 and the medial shafts 34 to engage upper arm muscles 38 and the abdominal muscles 36 of the person 14. Each of the medial shafts 34 may have a length between 4 inches and 8 inches. Each of the end shafts 28 and each of the medial shafts 34 has an opening 32 extending therethrough to access an interior of the end shafts 28 and the medial shafts 34.

Each of the end shafts 28 has a pair of free ends 42 and each of the medial shafts 34 has a free end 44. A plurality of balls 46 is provided. The balls 46 are coupled to the free end 42 of one of the end shafts 28 and the free end 44 of one of the medial shafts 34. The balls 46 prevent the person 14 from loosing grip on the medial shafts 34 and the end shafts 28.

A plurality of covers 48 is each removably coupled to one of the end shafts 28 and one of the medial shafts 34 and each opening 32 has an associated cover 48. A plurality of weights 50 is provided and a selected number of the weights 50 are removably positioned within the grippable member 12. The selected number of the weights 50 is positioned within the interior of each of the end shafts 28 and the medial shafts 34 to provide a selectable amount of resistance to the person 14 while the person 14 holds the grippable member 12.

A weapon 52 may be removably positioned within one of the end shafts 28. The weapon 52 may be utilized by the person 14 for defense purposes. Moreover, the weapon 52 may comprise a canister of pepper spray, a knife or the like.

In use, the person 14 grips the pair of end shafts 28 in order to engage shoulder muscles 54 and upper back muscles 56 of the person 14. The person 14 grips the central shaft 18 between the end shafts 28 and medial shafts 34 to engage the shoulder muscles 54 and upper back muscles 56. The person 14 grips the medial shafts 34 to engage the upper arm muscles 38 and outer abdominal muscles 60 of the person 14. The person 14 grips the central shaft 18 between the medial shafts 34 and the spring 26 to engage the upper arm muscles 38 and inner abdominal muscles 62 of the person 14. The person 14 utilizes the weapon 52 if the person 14 feels threatened while utilizing the grippable member 12. The selected number of weights 50 is inserted within the end shafts 28 and the medial shafts 34 in order to increase resistance placed on the shoulder muscles 54, upper back muscles 56, upper arm muscles 38, inner abdominal muscles 62 and outer abdominal muscles 60.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An exercise assembly configured to provide upper body exercise while walking, said assembly comprising:

a grippable member configured to be held by a person while the person is walking to facilitate the engagement of upper body muscles;

a plurality of weights, a selected number of said weights being removably positioned within said grippable member, said weights being configured to provide a selectable amount of resistance to the person while the person holds said grippable member;

a weapon removably positioned within one of said grippable member, said weapon being configured to be utilized by the person for defense purposes; and wherein said grippable member comprises a central shaft having a first end and a second end, said central shaft having a break therein, said break being centrally positioned on said central shaft, said shaft having a spring extending across said break such that said central shaft is flexible.

2. The assembly according to claim 1, further comprising a pair of end shafts each coupled to one of said first end and said second end, each of said end shafts being oriented transverse to a longitudinal axis extending through said first end and said second end, each of said end shafts being configured to be gripped by the person to engage back muscles of the person, said end shafts having an opening extending therethrough to access an interior of said end shafts.

3. The assembly according to claim 2, further comprising a pair of medial shafts coupled to said central shaft, each of said medial shafts being spaced inwardly from one of said end shafts, each of said medial shafts being oriented perpendicular to said central shaft such that said medial shafts are aligned with said end shafts, said medial shafts being configured to be gripped by the person to engage abdominal muscles of the person.

4. The assembly according to claim 3, wherein said central shaft is configured to be gripped between said end shafts and said medial shafts to engage upper arm muscles and the abdominal muscles of the person, said medial shafts each having an opening extending therethrough to access an interior of said medial shafts.

5. The assembly according to claim 4, wherein a plurality of covers each removably coupled to one of said end shafts and one of said medial shafts, each opening having an associated cover.

6. An exercise assembly configured to provide upper body exercise while walking, said assembly comprising:

a grippable member configured to be held by a person while the person is walking to facilitate the engagement of upper body muscles;

a plurality of weights, a selected number of said weights being removably positioned within said grippable member, said weights being configured to provide a selectable amount of resistance to the person while the person holds said grippable member;

a weapon removably positioned within one of said grippable member, said weapon being configured to be utilized by the person for defense purposes;

said grippable member including end shafts and medial shafts; and said selected number of said weights being positioned within said interior of each of said end shafts and said medial shafts.

7. An exercise assembly configured to provide upper body exercise while walking, said assembly comprising:

a grippable member configured to be held by a person while the person is walking to facilitate the engagement of upper body muscles, said grippable member comprising:

a central shaft having a first end and a second end, said central shaft having a break therein, said break being centrally positioned on said central shaft, said shaft having a spring extending across said break such that said central shaft is flexible;

a pair of end shafts each coupled to one of said first end and said second end, each of said end shafts being oriented transverse to a longitudinal axis extending through said first end and said second end, each of said end shafts being configured to be gripped by the person to engage back muscles of the person, said end shafts having an opening extending therethrough to access an interior of said end shafts;

a pair of medial shafts coupled to said central shaft, each of said medial shafts being spaced inwardly from one of said end shafts, each of said medial shafts being oriented perpendicular to said central shaft such that said medial shafts are aligned with said end shafts, said medial shafts being configured to be gripped by the person to engage abdominal muscles of the person, said central shaft being configured to be gripped between said end shafts and said medial shafts to engage upper arm muscles and the abdominal muscles of the person, said medial shafts each having an opening extending therethrough to access an interior of said medial shafts; and a plurality of covers each removably coupled to one of said end shafts and one of said medial shafts, each opening having an associated cover;

a plurality of weights, a selected number of said weights being removably positioned within said grippable member, said selected number of said weights being positioned within said interior of each of said end shafts and said medial shafts, said weights being configured to provide a selectable amount of resistance to the person while the person holds said grippable member; and a weapon removably positioned within one of said end shafts, said weapon being configured to be utilized by the person for defense purposes.

* * * * *